US007213526B1

(12) United States Patent
Hamilton

(10) Patent No.: US 7,213,526 B1
(45) Date of Patent: May 8, 2007

(54) PERSONAL WATERCRAFT LIFT

(76) Inventor: Terry Hamilton, 10290 Stringfellow Rd., St. James City, FL (US) 33956

( * ) Notice: Subject to any disclaimer, the term of this patent is extended or adjusted under 35 U.S.C. 154(b) by 0 days.

(21) Appl. No.: 11/268,788

(22) Filed: Nov. 8, 2005

(51) Int. Cl.
*B63C 7/00* (2006.01)

(52) U.S. Cl. ..... 114/44; 405/3

(58) Field of Classification Search ..... 114/44; 405/3

See application file for complete search history.

(56) References Cited

U.S. PATENT DOCUMENTS

| | | | | |
|---|---|---|---|---|
| 1,695,674 | A | 12/1928 | Wilson | |
| 2,808,016 | A | 10/1957 | Jamot | |
| 2,979,014 | A | 4/1961 | Yordi | |
| 2,990,803 | A | 7/1961 | Henderson | |
| 3,060,885 | A | 10/1962 | Nolf | |
| 3,177,839 | A | 4/1965 | Nolf | |
| 3,830,452 | A | 8/1974 | Seay | |
| 5,014,638 | A | 5/1991 | Ilves et al. | |
| 5,301,628 | A | 4/1994 | Daskalides | |
| 5,749,313 | A | 5/1998 | Shackelford, Jr. | |
| 5,803,003 | A * | 9/1998 | Vickers | 114/44 |
| 5,868,514 | A * | 2/1999 | Gibson | 403/3 |

FOREIGN PATENT DOCUMENTS

| | | |
|---|---|---|
| GB | 588394 | 5/1947 |

* cited by examiner

*Primary Examiner*—Stephen Avila
(74) *Attorney, Agent, or Firm*—The Livingston Firm; Edward M. Livingston; Angela M. Miller

(57) ABSTRACT

The personal watercraft lift attachable to a mooring piling 6 for raising and lowering a watercraft from the water is disclosed. The lift has a cradle 1 attached to a mast 2 secured between two brackets 26 and 30. A lift cable 8 attaches the cradle 1 to a power unit 27 with motor 4. Optional guard pipes 11 on the cradle are provided. The lift pivots approximately 180° to enable easy accessibility to a PWC for mounting, demounting storage and maintenance.

8 Claims, 4 Drawing Sheets

PERSONAL WATERCRAFT LIFT

BACKGROUND OF THE INVENTION

This invention relates to lifting devices for watercraft, more particularly, to a lift for personal watercraft that is pivotally attached to a mooring piling above the surface of the water which allows the watercraft to be lowered into the water for use and then raised from the water and pivoted onto a dock for mounting, demounting storage and servicing.

All watercraft owners know it is desirable that watercraft be stored out of the water to prevent defiling by barnacles, algae, and other waterborn plants and animals, as such requires expensive and time-consuming periodic cleaning of the bottom surfaces of the watercraft. Although there are watercraft lifts available to raise and store watercraft out of the water, many such lifts are at least partially submerged in water, which leads to defiling of the lift by aquatic plants and animals and shortens the life of the lift. Also, many prior lifts only lift the watercraft out of the water, but do not store it in an easily accessible position for cleaning, maintenance, and mounting or demounting during use. Furthermore, many such lifts require that the watercraft be elevated out of the water by manual means. However, as personal watercrafts often weigh an excess of 750 pounds, it is difficult to lift them without motorized means.

Thus, there is a need for a watercraft lift that will address the above problems. The relevant prior art includes the following references:

| Patent No. | Inventor | Issue/Publication Date |
|---|---|---|
| (U.S. unless stated otherwise) | | |
| 5,749,313 | Shackelford, Jr. | May 12, 1998 |
| 1,695,674 | Wilson | Dec. 18, 1928 |
| 2,808,016 | Jamot | Oct. 1, 1957 |
| 2,990,803 | Henderson | Jul. 4, 1961 |
| 2,979,014 | Yordi | Apr. 11, 1961 |
| 3,060,885 | Nolf | Oct. 30, 1962 |
| 3,177,839 | Nolf | Apr. 13, 1965 |
| 3,830,452 | Seay | Aug. 20, 1974 |
| 5,014,638 | Ilves et al. | May 14, 1991 |
| 5,301,628 | Daskalides | Apr. 12, 1994 |
| GB 588,394 | Lamb et al. | May 21, 1947 |

Of the above patents only the Shackelford Jr., patent provides some of the advantages of the present invention. However, the present invention, contrary to the Shackelford, Jr., patent differs as it utilizes two separate brackets rather than a tubular housing, has fewer moving parts and is motorized.

SUMMARY OF THE INVENTION

The primary object of the present invention is to provide a personal watercraft lift that enables a personal watercraft to be raised and lowered into the water easily and quickly.

A further object of the present invention is to provide a personal watercraft lift that allows personal watercraft to be stored out of the water.

An even further object of the present invention is to provide a personal watercraft lift that provides easy accessibility to the personal watercraft for mounting and demounting during use and for maintenance purposes.

Another object of the present invention is to provide a personal watercraft lift that has fewer moving parts than watercraft lifts in the prior art.

An additional object of the present invention is to provide as a personal watercraft lift that is easy to install and maintain.

Yet another object of the present invention is to provide such as a personal watercraft lift that is motorized.

A further object of the present invention is to provide a more secure piling attachment means.

The present invention fulfills the above and other objects by providing a personal watercraft lift for use with a mooring piling having a mounting bracket for attaching the lift to the mooring piling above the surface of the water to which mounting brackets are attached. Both brackets are connected by a front plate and together serve as a guide means for an elongate lift mast. The lower of the two brackets has a roller on the inner side abutting the mast and the upper bracket has a slide block on the outer side so as to also abut the mast to result in a rolling and sliding movement of the mast between them. To the lower end of the mast is attached a cradle. The cradle is also attached by a cable to a motorized means mounted to the front plate of the bracket which allows the lift to be raised and lowered. The lift may be rotated in a lifting position over the body of water or inward to a storage position out of the water, preferably over a dock. A locking pin on the top bracket may be used to secure the lift underneath the lifting or the storage position. The cradle may contain optional vertical upright guards to keep personal watercraft from hitting the cable or the mast as well as crossbars for preventing the personal watercraft lift from moving laterally when it is positioned on the cradle. Further, a more secure piling attachment of the lift is achieved by attachment bolts being angled through the piling.

The above and other objects, features and advantages of the present invention should become even more readily apparent to those skilled in the art upon a reading of the following detailed description in conduction with the drawing wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
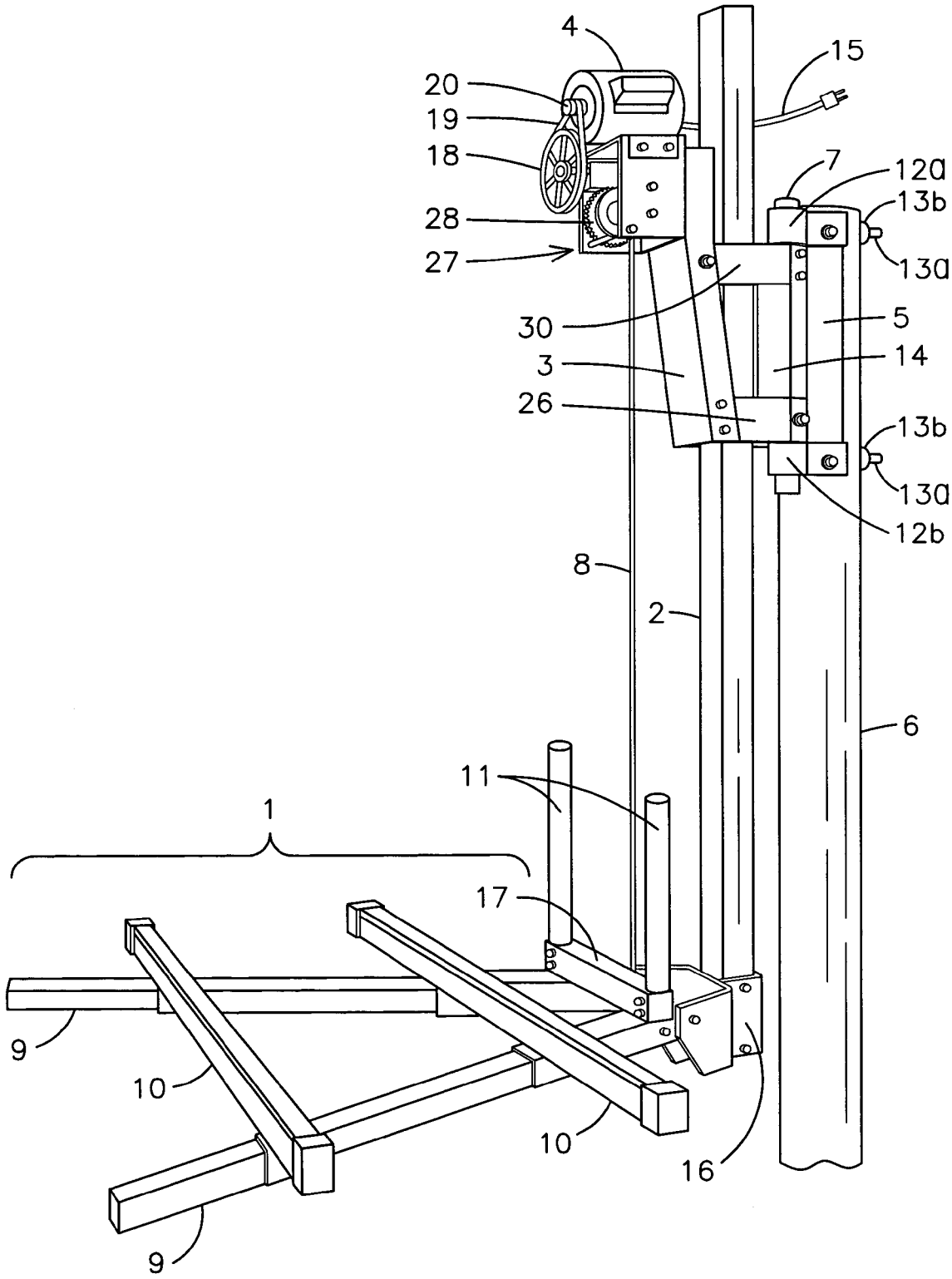
FIG. 1 is a perspective view of the personal watercraft lift of the present invention when attached to a mooring piling as it would appear during use.

For purposes of describing the preferred embodiment, the terminology used in reference to the numbered components in the drawings is as follows:

| | |
|---|---|
| 1. | PWC cradle |
| 2. | mast |
| 3. | mast holding cover |
| 4. | motor |
| 5. | piling bracket |
| 6. | piling |
| 7. | pivot pin |
| 8. | lift cable |
| 9. | cradle support rails |
| 10. | cradle PWC support cross rails |
| 11. | guard pipes |
| 12. a, b | pivot brackets |
| 13. a | piling attachment bolts |
| 13. b | piling attachment nuts |
| 14. | pivot head |
| 15. | Ac power cord |
| 16 | mast cradle receiver |
| 17 | bunk board |
| 18 | large pulley |
| 19 | belt |
| 20 | small pulley |
| 21 | dock |
| 22 | PWC |
| 23 | roller |
| 24 | sliding block |
| 25 | pivot arrow |
| 26 | lower mast guide bracket |
| 27 | power unit |
| 28 | gear drive |
| 29 | pivot pin shaft |
| 30 | top mast guide bracket |
| 31 | pivot licking pin |
| 32 | gear shaft |
| 33 | bolt holes |
| 34 | top mast guide bracket retaining bolts |
| 35 | lower mast guide bracket retaining bolts |
| 36 | sliding block retaining pin |
| 37 | roller retaining pin |
| 38 | PWC lift position |
| 39 | PWC storage position |
| 40 | cable spool |
| 41 | side walls of top bracket |
| 42 | side walls of bottom bracket |

Referring now to FIG. 1, the entire personal watercraft, PWC, lift of the present invention is shown attached to a mooring piling 6. The PWC lift is attached to the mooring pilings 6 by a piling bracket 5 with bolts and nuts 13 that are long enough to pass through the piling 6. The piling bracket 5 has two pivot brackets 12*a* and 12*b* holding a pivot pin 7 to which is mounted a pivot head 14. In turn, attached to the pivot head 14 are two mast guide brackets, a lower bracket 26 and upper bracket 30 which are connected by a cover 3. An elongate mast 2, which is preferably made of a non-corrosive metal such as stainless steel or aluminum, is contained between the guide brackets 26 and 30 and cover 3.

A cradle 1 is attached at a lower end of the mast 2 by a cradle receiver 16. The cradle 1 is designed to hold a PWC on support rails 9 which preferably have cross rails 10 for providing lateral support to a PWC when placed on the cradle 1. Optional guide pipes 11 made of PVC or other flexible material are mounted on a bunk board 17 attached to proximate an inner end of the cradle 1 to prevent a PWC from hitting the mast 2 or lift cable 8. The cradle 1 is attached to a winch unit 27 by a lift cable 8. The power unit 27 is shown attached to a top portion of the cover 3 connecting the mast guide brackets 26 and 30. The winch unit 2 may be manual or preferably motorized as shown, whereby a motor 4 turns a gear drive 28 to roll up or unroll the lift cable 8 to raise or lower the cradle 1, respectively. The motor 4 is operatively connected to the gear drive 28 by a large pulley 18, v-belt 19 and small pulley 20. The motor 4 would be connected to a power source by an AC power cord 15.

Figure 2:
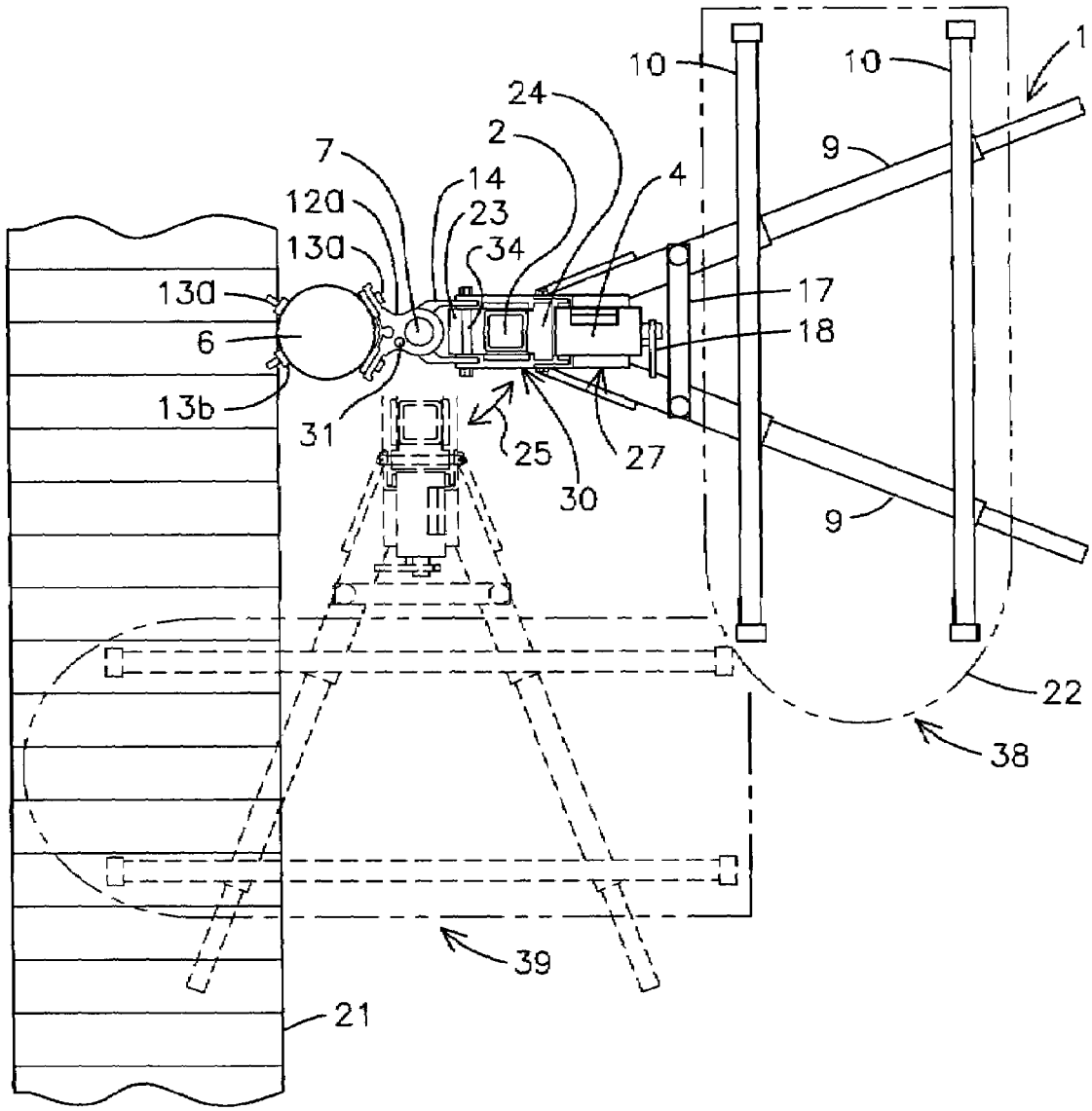
FIG. 2 is a top view of the personal watercraft lift of the present invention during use showing a personal watercraft in broken lines in a lowered lifting position over water and a raised pivoted position over a dock and in a storage position.

FIG. 2 shows a top view of the PWC lift of the present invention with a PWC (in broken lines) in both a lowered lift position 38 and at a raised storage position 39 above a dock 21. In the lowered lift position 38, the PWC 22 rests on the cross rails 10 of the cradle support rails 9 of the cradle 1. The cradle 1 would be lowered to the point where it would be just below the water so the PWC 22 could be driven onto the cross rails 10, then raised and pivoted into a raised storage position 39 over a dock 21. In the storage position 39, a user would have easy access to the PWC 22 for mounting and dismounting during use or for cleaning and maintenance of the PWC.

Figure 6:
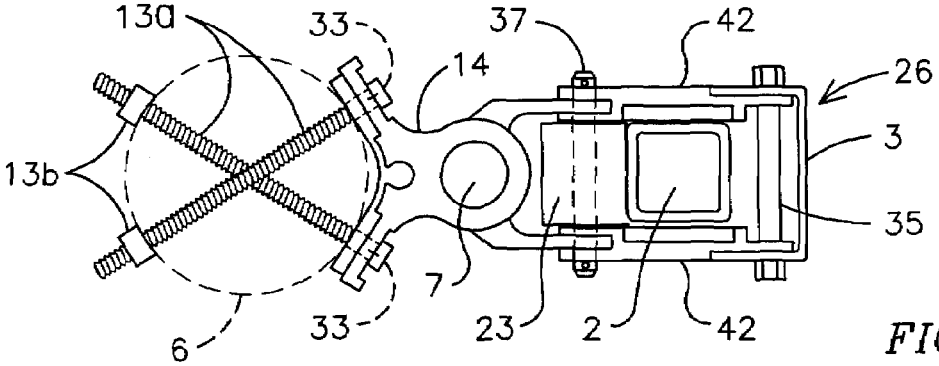
FIG. 6 is a top partial plan view of the lower mast guide bracket with piling attachment method of the personal watercraft lift of the present invention.

As further shown in FIG. 2, is the mast 2 is abuts a sliding block 24 in the top mast guide bracket 30 and a roller 23 in the lower mast guide bracket 26 (not shown in this FIG. 2, but see FIG. 6). There is one or more top mast guide bracket retaining bolts 34 which further help retain the mast within the top mast bracket 30. A lock pin 31 can be inserted through a hole in the top pivot bracket 12*a* to maintain the lift in the raised or storage positions, 38 and 39, respectively.

Figure 3:
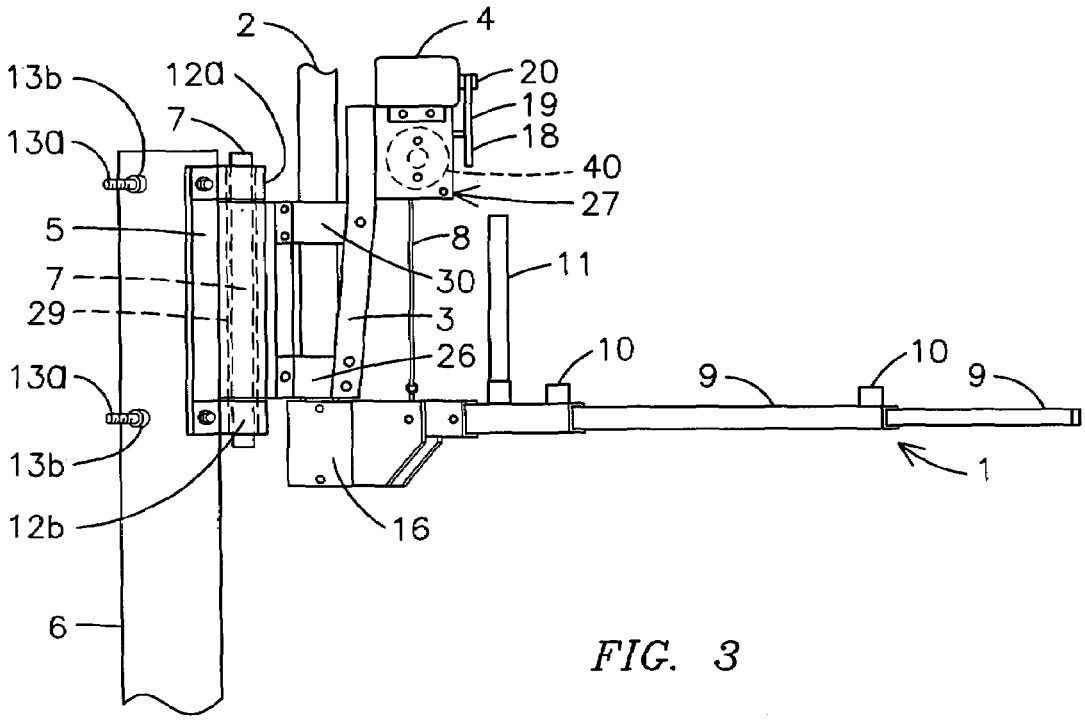
FIG. 3 is a side partial plan view of the personal watercraft lift of the present invention in a raid position.

In FIG. 3, the PWC lift of the present invention is shown in a side elevation view wherein the cradle 1 is in a raised position with the mast 2 at its highest point in which the cradle receiver 16 abuts the lower mast guide bracket 26. The raising of the cradle 1 is accomplished by activating the motor 4 by switch or remote means resulting in turning the small pulley 12, the belt 19, the large pulley 18 and gear drive 27 which rolls up the lift cable 8 onto a spool 40. Once the cradle 1 is in the elevated position, the cradle 1 may by pivoted by around a pivot pin 7 held within pivot brackets, 12*a* and 12*b*, until it is in the desired position.

Figure 4:
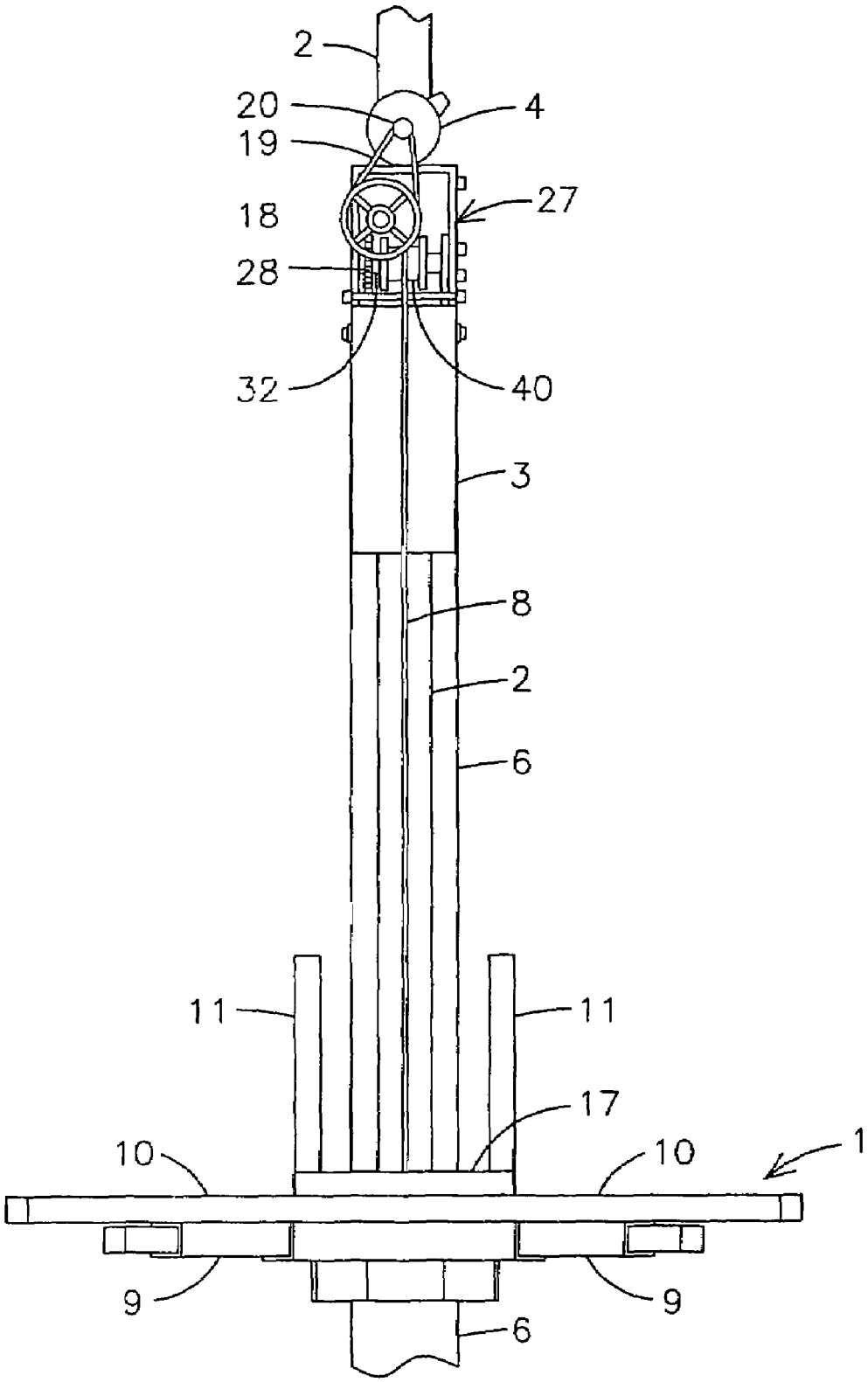
FIG. 4 is a front view of the watercraft lift with a cradle in a lowered position.

FIG. 4 shows the PWC lift of the present invention from a frontal view when in a lowered position. This view shows the components of the PWC lift as previously discussed, including the cradle 1, formed by cradle support rails 9, cross rails 10, with optimal bunk boards 17, and guide pipes 11 all attached at the bottom of the mast 2. A lift cable 8 connects the cradle 1 to a cable spool 40 within the power unit 27. The power unit 27 is attached to the top front of the front cover 3 and the motor 4 is mounted on the top of the front cover 3. The power unit 27 contains a gear shaft 32 with cable spool 40. The gear shaft 32 operatively engages the large pulley 18, connected by v-belt 19 to the small pulley 20 on the motor 4.

Figure 5:
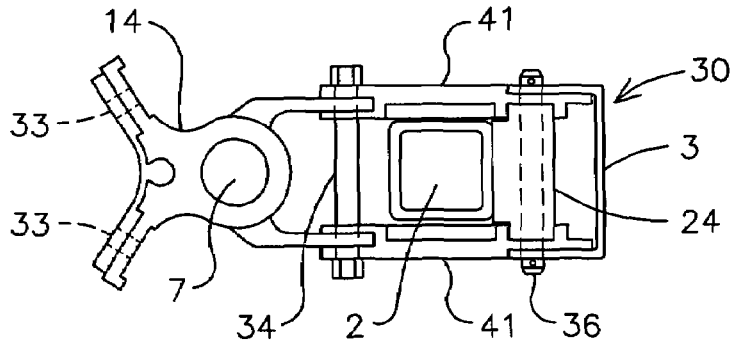
FIG. 5 is a top view of a top partial plan view of the top mast guide bracket of the present invention.

FIGS. 5 and 6, illustrate in more detail the components of the top and lower mast guide brackets 30 and 26, respectively. The top mast guide bracket 30 shown in FIG. 5 contains a sliding block 24 mounted between the side 41 by a retaining pin 36. Behind the mast 2 are one or more retaining bolts 34 which secure the top bracket 30 around the pivot pin 7 in the pivot head 14.

In the lower mast guide bracket 26 shown in FIG. 6, the mast 2 abuts a roller of 23 mounted on a retaining pin 37 between side walls 42. A retaining bolt 35 in front of the mast 2 holds the front plate 3 to the side walls 42. The side walls 42 are secured to the lower bracket 26 by the rolling retaining pin 37 which also secures the lower mast guide bracket 26.

Finally, as shown in FIG. 6, a more secure piling attachment method is used for the mounting bracket 14. This method consists of placing the mounting bracket attachment bolts 13*a* through the piling 6 at an angle crossing each other and securing them with bolts 13*b*, rather than straight through the piling as in the prior art. This attachment method provides for a safer and stronger PWC lift.

It is to be understood that while a preferred embodiment of the invention is illustrated, it is not to be limited to the specific form or arrangement of parts herein described and show. It will be apparent to those skilled in the art that various changes may be made without departing from the scope of the invention and the invention is not be considered limited to what is shown and described in the specification and drawings.

Having thus described my invention, I claim:

1. A personal watercraft lift attachable to a mooring piling for removing a watercraft into and out of water, said lift comprising:

a mounting bracket for attaching the lift to the mooring piling above a surface of the water;

means for attaching the mounting bracket to the mooring piling;

a top bracket connected perpendicularly to the mounting bracket, said top bracket having two side walls for containing a mast and a sliding block on an outer side abutting the mast;

a lower bracket also connected perpendicularly to the mounting bracket having at least one roller on an inner side abutting the mast;

an elongate mast vertically contained within the top and lower brackets;

a winch means attached to the top bracket;

a personal watercraft holding cradle attached to a lower end of the elongate mast;

and a cable operatively connecting the cradle to the winch means for raising and lowering the cradle, wherein the top and lower brackets are pivotally attached to the mounting brackets so that the cradle can be pivoted to desired storage and use positions; and further comprising locking means on the top bracket wherein the lift may be retained in a fixed position.

2. The personal watercraft lift of claim 1 wherein the winch means is motorized.

3. The personal watercraft lift of claim 1 wherein the cradle further comprises a guard means to help prevent the personal watercraft lift from hitting against the cable and mast of the lift.

4. The personal watercraft lift of claim 1 wherein the cradle comprises lengthwise support rails with crossing lateral support rails on said lengthwise support rails for a holding the personal watercraft in a non-tilting position during lifting for use and storage.

5. A personal watercraft lift attachable to a mooring piling for removing a watercraft into and out of water, said lift comprising;

a mounting bracket for attaching the lift to the mooring piling above a surface of the water;

means for attaching the mounting bracket to the mooring piling;

a top bracket connected perpendicularly to the mounting bracket, said top bracket having two side walls for containing a mast and a sliding block on an outer side abutting the mast;

a lower bracket also connected perpendicularly to the mounting bracket having at least one roller on an inner side abutting the mast;

an elongate mast vertically contained within the top and lower brackets;

a winch means attached to the top bracket;

a personal watercraft holding cradle attached to a lower end of the elongate mast;

a cable operatively connecting the cradle to the winch means for raising and lowering the cradle, and a guide means to help prevent the personal watercraft lift from hitting against the cable and mast of the lift, said guide means comprising guard pipes vertically mounted on the cradle at a position between the lift cable and a personal watercraft to be mounted to help prevent the personal watercraft lift from hitting against the cable and mast of the lift.

6. The personal watercraft lift of claim 1 wherein the locking means comprises a vertical hole on the top bracket near the mounting bracket and a pin insertable into said hole in a manner such that the cradle will not pivot.

7. The personal watercraft lift of claim 1 further comprising a cover on a front side of and connecting the top and lower brackets for further securing and guiding the mast.

8. A personal watercraft lift attachable to a mooring piling for removing a watercraft into and out of water, said lift comprising:

a mounting bracket for attaching the lift to the mooring piling above a surface of the water;

means for attaching the mounting bracket to the mooring piling;

a top bracket connected perpendicularly to the mounting bracket, said top bracket having two side walls for containing a mast and a sliding block on an outer side abutting the mast;

a lower bracket also connected perpendicularly to the mounting bracket having at least one roller on an inner side abutting the mast;

an elongate mast vertically contained within the top and lower brackets;

a winch means attached to the top bracket;

a personal watercraft holding cradle attached to a lower end of the elongate mast; and a cable operatively connecting the cradle to the winch means for raising and lowering the cradle, and wherein the means for attaching the mounting bracket to the mooring piling comprises a plurality of bolts inserted through the mooring piling at cross angles to each other.

* * * * *